US007896334B2

(12) United States Patent
Sugizaki

(10) Patent No.: US 7,896,334 B2
(45) Date of Patent: Mar. 1, 2011

(54) SHEET POST-PROCESSING APPARATUS

(75) Inventor: Yoshiaki Sugizaki, Sunto-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/885,771

(22) Filed: Sep. 20, 2010

(65) Prior Publication Data

US 2011/0006468 A1 Jan. 13, 2011

Related U.S. Application Data

(63) Continuation of application No. 11/681,523, filed on Mar. 2, 2007.

(51) Int. Cl.
*B65H 39/00* (2006.01)

(52) U.S. Cl. ..... 270/58.12; 270/58.07; 270/58.17; 270/58.27

(58) Field of Classification Search ..... 270/58.07, 270/58.08, 58.09, 58.11, 58.12, 58.17, 58.27
See application file for complete search history.

(56) References Cited

U.S. PATENT DOCUMENTS

| | | | |
|---|---|---|---|
| 6,375,180 | B1 | 4/2002 | Kawano et al. |
| 6,382,616 | B1 | 5/2002 | Waragai et al. |
| 7,389,980 | B2 | 6/2008 | Kushida |
| 2008/0099972 | A1 | 5/2008 | Hayashi |
| 2008/0237965 | A1 | 10/2008 | Moriyama et al. |
| 2008/0308985 | A1 * | 12/2008 | Sasahara et al. ..... 270/1.01 |
| 2008/0308991 | A1 * | 12/2008 | Sasahara et al. ..... 270/58.08 |

FOREIGN PATENT DOCUMENTS

| | | |
|---|---|---|
| JP | 2004091171 | 3/2004 |
| JP | 2004-269186 | 9/2004 |
| JP | 2004-277158 | 10/2004 |
| JP | 2006-124156 | 5/2006 |

OTHER PUBLICATIONS

Chinese Office Action for 200810006376.8 mailed on Sep. 18, 2009.

U.S. Office Action mailed Oct. 8, 2009 corresponding to U.S. Appl. No. 11/681,523.

U.S. Office Action mailed Feb. 25, 2010 corresponding to U.S. Appl. No. 11/681,523.

* cited by examiner

*Primary Examiner* — Leslie A Nicholson, III

(74) *Attorney, Agent, or Firm* — Turocy & Watson, LLP

(57) ABSTRACT

A sheet post-processing apparatus includes a sheet aligning device that increases, when the number of sheets conveyed thereto exceeds a predetermined number, the number of times of an aligning operation of the sheet aligning device, which aligns the sheets conveyed thereto, to be larger than the number of times of the aligning operation at the number of sheets equal to or smaller than this predetermined number.

19 Claims, 9 Drawing Sheets

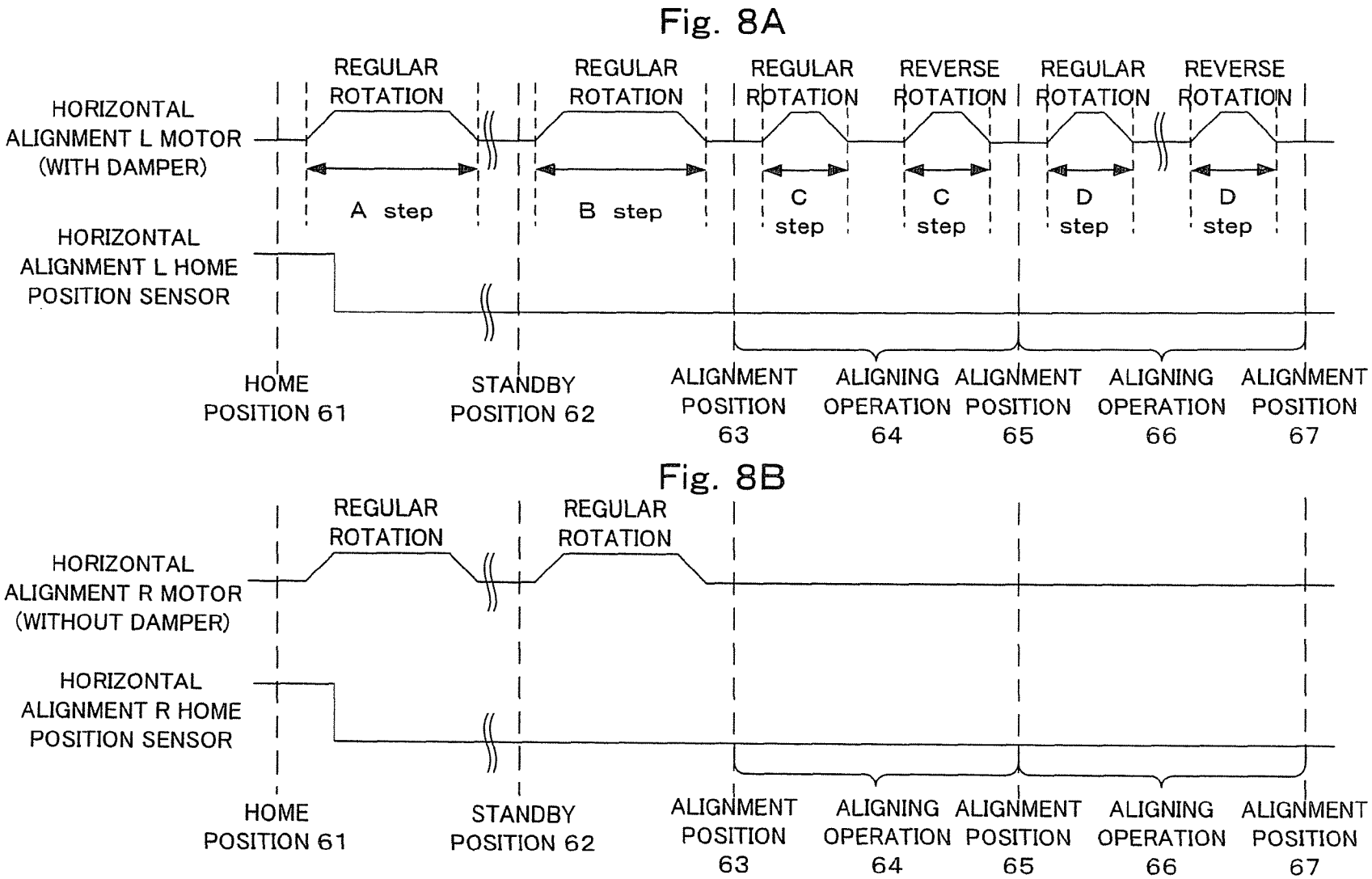
Fig. 8A
HORIZONTAL ALIGNMENT L MOTOR (WITH DAMPER)
HORIZONTAL ALIGNMENT L HOME POSITION SENSOR
REGULAR ROTATION
A step
REGULAR ROTATION
B step
REGULAR ROTATION
C step
REVERSE ROTATION
C step
REGULAR ROTATION
D step
REVERSE ROTATION
D step
HOME POSITION 61
STANDBY POSITION 62
ALIGNMENT POSITION 63
ALIGNING OPERATION 64
ALIGNMENT POSITION 65
ALIGNING OPERATION 66
ALIGNMENT POSITION 67
Fig. 8B
HORIZONTAL ALIGNMENT R MOTOR (WITHOUT DAMPER)
HORIZONTAL ALIGNMENT R HOME POSITION SENSOR
REGULAR ROTATION
REGULAR ROTATION
HOME POSITION 61
STANDBY POSITION 62
ALIGNMENT POSITION 63
ALIGNING OPERATION 64
ALIGNMENT POSITION 65
ALIGNING OPERATION 66
ALIGNMENT POSITION 67

PADDLE MOTOR
PADDLE HOME POSITION SENSOR
REGULAR ROTATION
REGULAR ROTATION
REVERSE ROTATION
FIRST ROTATION
SECOND ROTATION

PADDLE MOTOR
PADDLE HOME POSITION SENSOR
REGULAR ROTATION
REGULAR ROTATION
REVERSE ROTATION
FIRST ROTATION
SECOND ROTATION
THIRD ROTATION

SHEET POST-PROCESSING APPARATUS

CROSS-REFERENCE TO RELATED APPLICATIONS

This application is a Continuation of application Ser. No. 11/681,523 filed on Mar. 2, 2007, the entire contents of which are incorporated herein by reference.

BACKGROUND OF THE INVENTION

1. Field of the Invention

The present invention relates to a sheet post-processing apparatus including a sheet aligning device that aligns sheets conveyed thereto in the case of staple processing and the like.

2. Description of the Related Art

When sheets subjected to image formation in an image forming apparatus is received and post-process processing such as staple processing and punching processing is performed in a sheet post-processing apparatus that applies post-processing, it is necessary to align the sheets prior to this post-process processing.

Conventionally, a first aligning plate and a second aligning plate that nip a bundle of sheets are provided, the first aligning plate and the second aligning plate are moved in a direction of the bundle of sheets, one of the aligning plates is provisionally fixed, and the other aligning plate is further moved in the direction of the bundle of sheets to perform alignment in a horizontal direction. A rotor having a paddle is rotated to bring the paddle into contact with the sheets conveyed thereto and the sheets are drawn in by the paddle and struck against a stopper to perform alignment in a vertical direction. (For example, JP-A-2006-124156).

However, when the number of sheets increases, the sheets less easily move to a side and alignment cannot be performed satisfactorily. If a force for moving the aligning plates is increased, when there are few sheets, the sheets bend and alignment of the sheets is disordered. In this way, in the conventional sheet aligning device, since only one kind of setting for an aligning operation can be performed, there is a problem in that it is difficult to set the aligning operation to appropriately perform alignment of sheets even when there are few sheets or many sheets.

BRIEF SUMMARY OF THE INVENTION

It is an object of the present invention to provide a sheet post-processing apparatus including a sheet aligning device that increases, when the number of sheets conveyed thereto exceeds a predetermined number, the number of times of an aligning operation of the sheet aligning device to be larger than the number of times of an aligning operation at the number of sheets equal to or smaller than the predetermined number of sheets.

In an aspect of the present invention, a sheet post-processing apparatus includes a processing tray that receives sheets subjected to image formation from an image forming apparatus, a sheet discharge tray that stacks the sheets discharged after processing in a post process, and a sheet aligning device having a vertical aligning device that aligns the sheets conveyed to the processing tray in a conveying direction, a horizontal aligning device that aligns the sheets conveyed to the processing tray in a direction perpendicular to the conveying direction, and a control unit that controls aligning operations of the vertical aligning device and the horizontal aligning device and increases, in subjecting the sheets to staple processing, when the number of the sheets conveyed thereto exceeds a predetermined number, the number of times of the aligning operation of the vertical aligning device or the horizontal aligning device to be larger than the number of times of the aligning operation at the number of sheets equal to or smaller than the predetermined number of sheets.

DESCRIPTION OF THE DRAWINGS

FIG. 8A is a timing chart of a horizontal alignment L motor, which moves a first aligning plate, and a horizontal alignment L home position sensor;

FIG. 8B is a timing chart of a horizontal alignment R motor, which moves a second aligning plate, and a horizontal alignment R home position sensor;

DETAILED DESCRIPTION OF THE INVENTION

Figure 1:
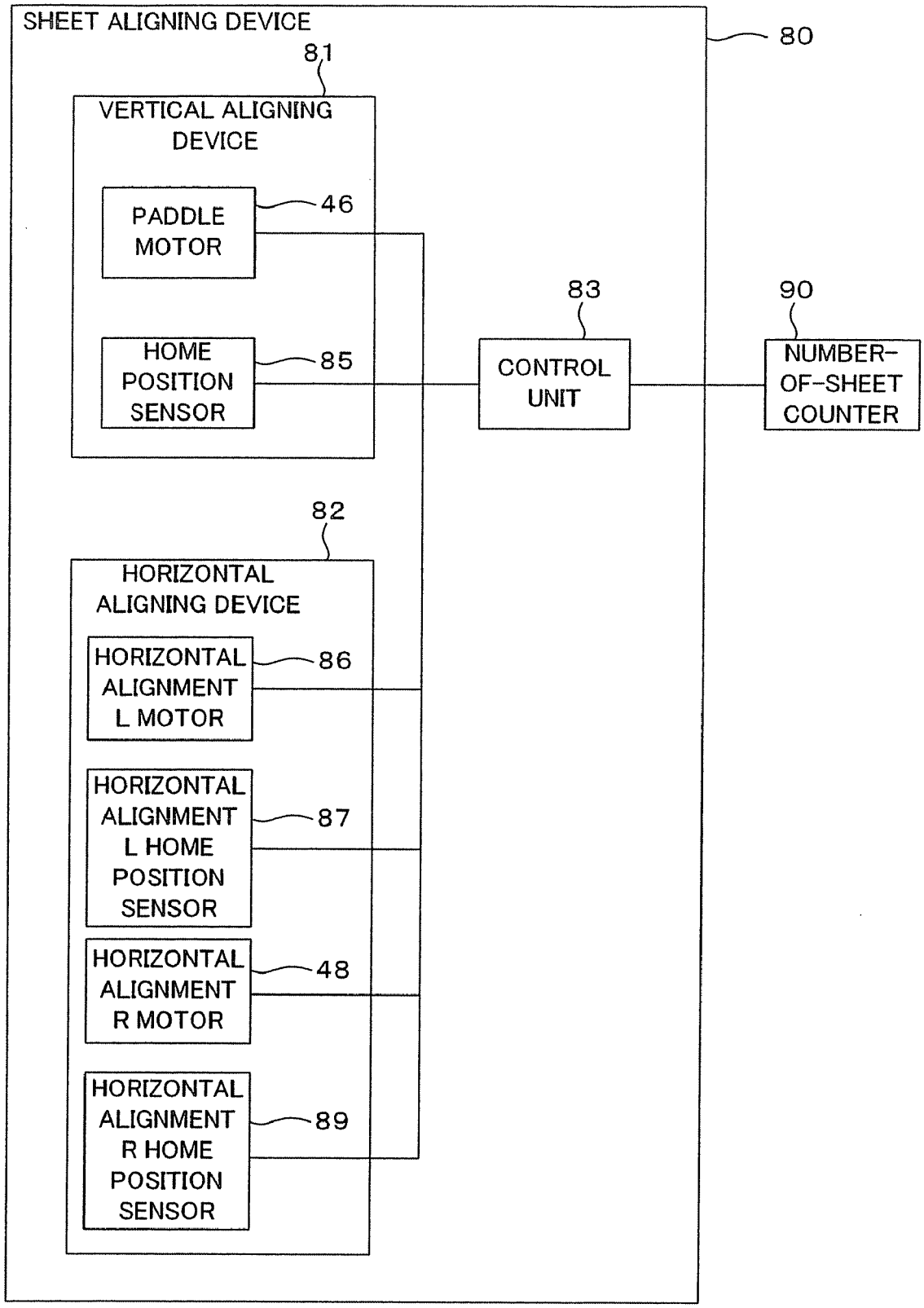
FIG. 1 is a schematic diagram of a structure concerning control of a sheet aligning device.

Throughout this description, the embodiments and examples shown should be considered as exemplars, rather than limitations on the apparatus and methods of the present invention.

An embodiment of the invention will be hereinafter explained using the drawings. In the respective figures, identical components are denoted by identical reference numerals and signs and redundant explanations are omitted.

A sheet post-processing apparatus performs, for example, staple processing, punching processing, and folding processing as processing of a post process of an image forming apparatus. In that case, since it is necessary to align sheets subjected to image formation, i.e., align vertical and horizontal sides of the sheets, a sheet aligning device is provided in the sheet post-processing apparatus.

FIG. 1 is a schematic diagram of a structure concerning control of the sheet aligning device built in the sheet post-processing apparatus according to this embodiment. A sheet aligning device 80 includes a vertical aligning device 81 that aligns sheets conveyed to the sheet aligning device 80 in a conveying direction, a horizontal aligning device 82 that aligns the sheets conveyed thereto in a direction perpendicular to the conveying direction, and a control unit 83 that controls aligning operations of the vertical aligning device 81 and the horizontal aligning device 82.

This control unit 83 may be independently provided for exclusive use of the sheet aligning device 80, may be provided as a part of a control unit of the sheet post-processing apparatus integrated with the sheet aligning device 80, or may be provided as apart of a control unit of an image forming apparatus with which the sheet post-processing apparatus is provided in parallel. When the control unit 83 is independently provided, the control unit 83 includes a CPU or a processor, a memory, a storage device, and a communicating device.

The control unit 83 is connected to a number-of-sheet counter 90 that counts the number of sheets conveyed to the sheet aligning device 80. The number-of-sheet counter 90 may be provided in the sheet post-processing apparatus integrated with the sheet aligning device 80 or may be provided in an image forming apparatus in which the sheet post-processing apparatus is set. The number-of-sheet counter 90 may be provided for exclusive use of the sheet aligning device 80. In this case, the number-of-sheet counter 90 may have an interface for transmitting and receiving data to and from a sheet sensor and the control unit 83.

The control unit 83 is connected to a paddle motor 46 of the vertical aligning device 81, which is a motor that rotates a paddle that aligns sheets in a conveying direction, a home position sensor 85 that detects a home position of the paddle, a horizontal alignment L roller 86 that moves a first aligning plate of the horizontal aligning device 82, a horizontal alignment L home position sensor 87 that detects a home position of the first aligning plate, a horizontal alignment R motor 48 that moves a second aligning plate of the horizontal aligning device 82, and a horizontal alignment R home position sensor 89 that detects a home position of the second aligning plate.

In this embodiment, two motors, namely, the horizontal alignment L motor 86 and the horizontal alignment R motor 48 are used in the horizontal aligning device 82. However, the respective aligning plates may be moved by one motor.

Figure 2:
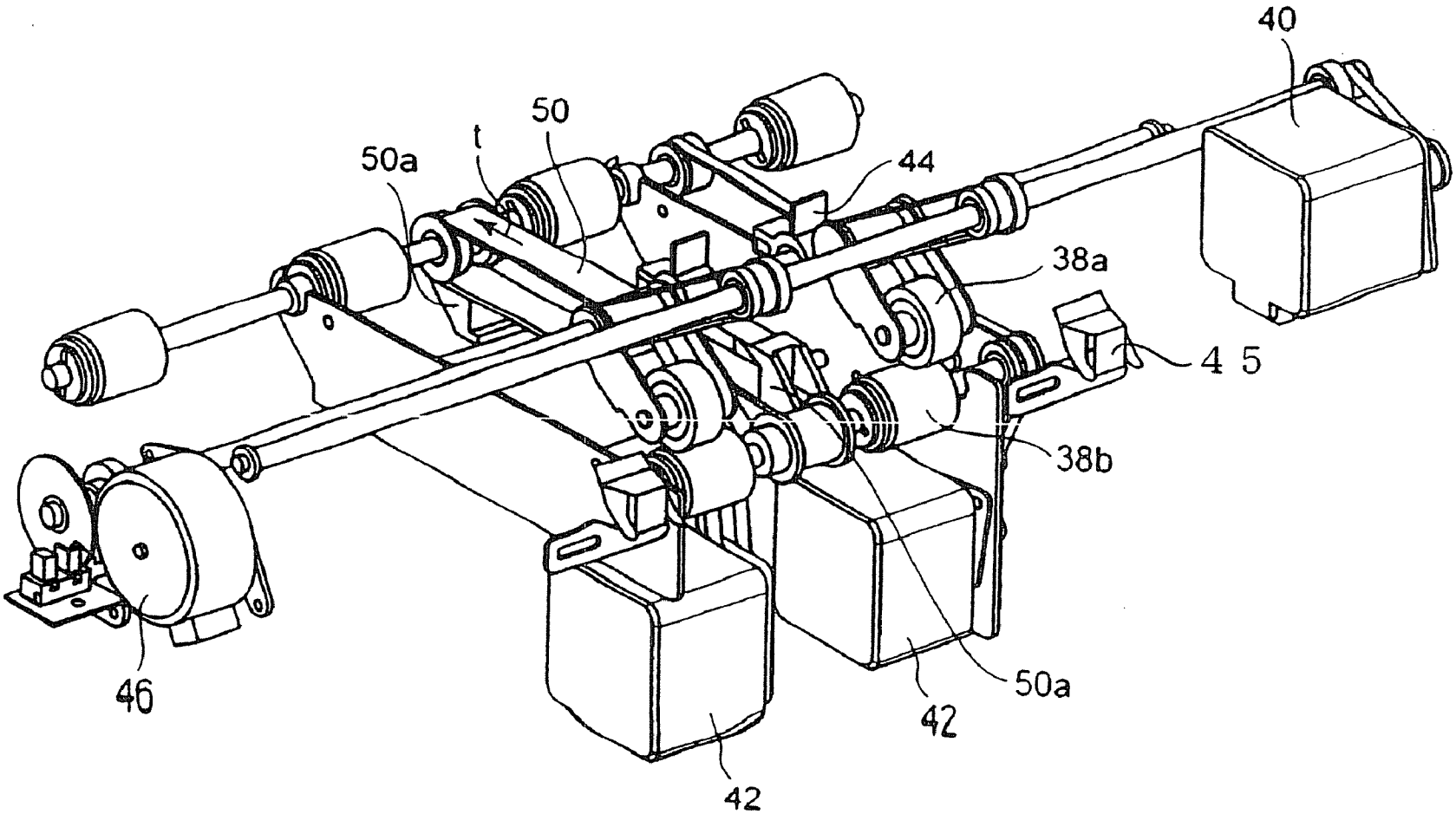
FIG. 2 is a perspective view of a vertical aligning device.

FIG. 2 is a perspective view of the vertical aligning device 81 according to this embodiment. The vertical aligning device 81 includes a paddle 44 provided radially with respect to a rotation axis in a rotor, a paddle motor 46 that rotates this rotor, a stopper 45 against which a leading end of sheets is struck to align the sheets, and a not-shown home position sensor 85. When the sheet aligning devices are set in the sheet post-processing apparatus, a conveyor belt 50 that conveys aligned sheets to a processing tray in order to perform processing such as stapling may be provided.

Figure 3:
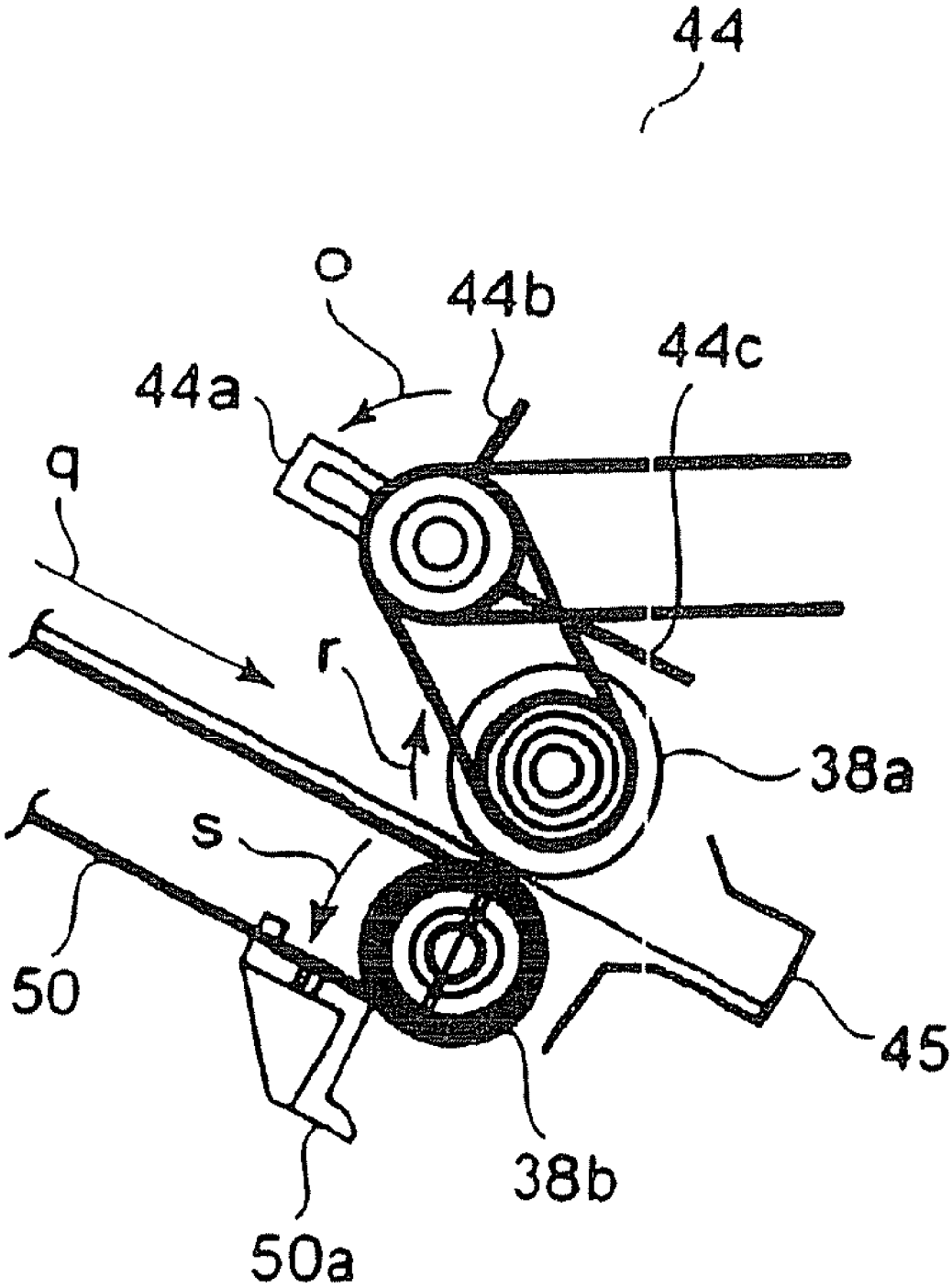
FIG. 3 is a diagram of the vertical aligning device viewed from the side.

FIG. 3 is a diagram of the vertical aligning device 81 viewed from the side. Sheets are conveyed in an arrow q direction. The paddle 44 is provided in the rotor to be radial in three directions. The paddle 44 has a receiving unit 44*a*, a tapping unit 446 that taps down the sheets, and a sending unit 44*c* that aligns the sheets. The paddle 44 is driven by the paddle motor 46. The paddle 44 is formed of resin having elasticity. When sheets are conveyed thereto, the paddles 44*a*, 44*b*, and 44*c* rotate in a direction of an arrow o, come into contact with the sheets, tap down the sheets, draw the sheets into the stopper 45, and strike the sheets against the stopper 45 to align the sheets in the sheet conveying direction.

Figure 4:
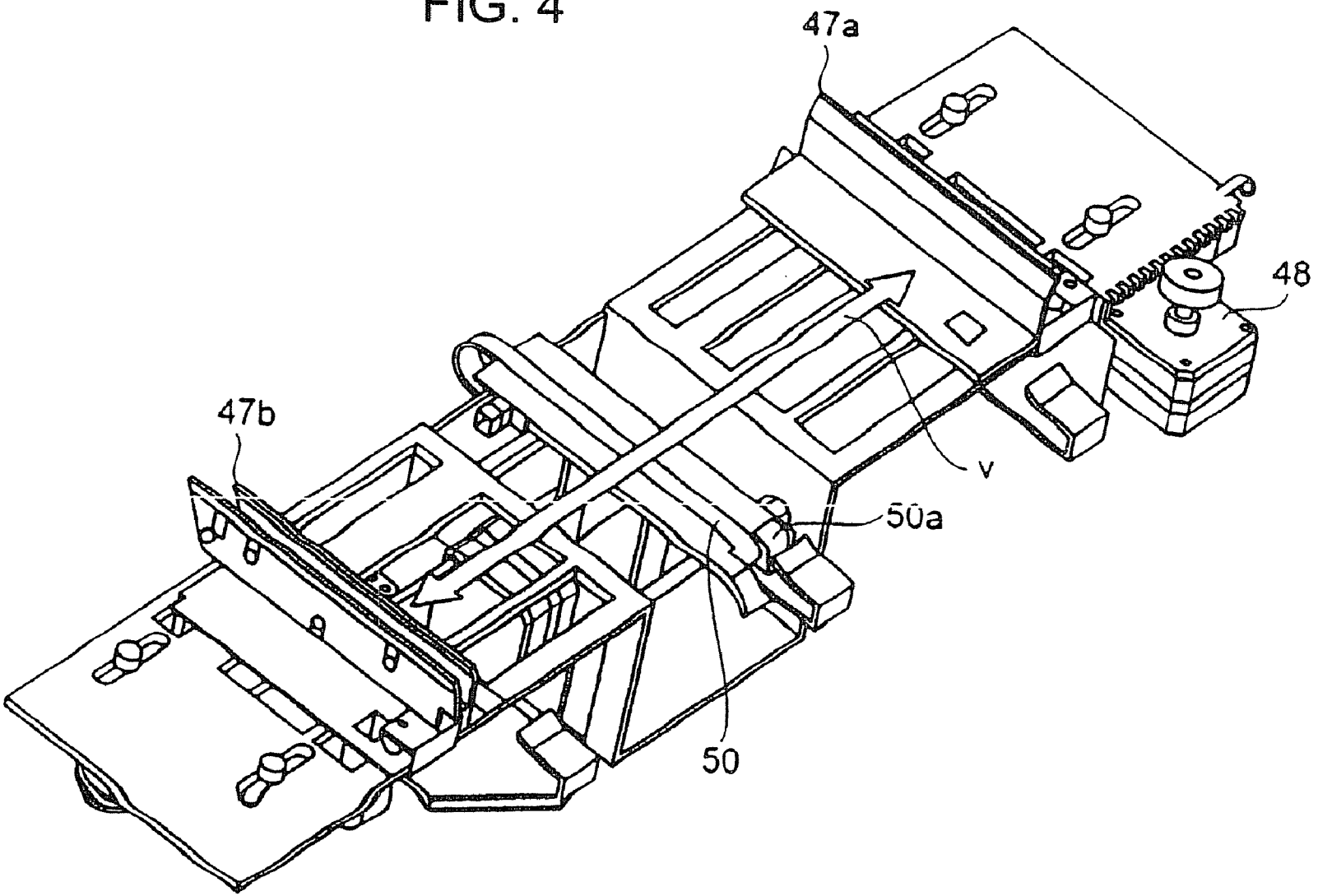
FIG. 4 is a perspective view of a horizontal aligning device.

FIG. 4 is a perspective view of the horizontal aligning device 82. The horizontal aligning device 82 includes a first aligning plate 47*b*, a second aligning plate 47*a*, a horizontal alignment L motor 86 and a horizontal alignment L home position sensor 87, which are not shown in the figure, a horizontal alignment R motor 48, and a not-shown horizontal alignment R home position sensor 89.

The first aligning plate 47*b* and the second aligning plate 47*a* reciprocatingly move in a direction of an arrow v perpendicular to the conveying direction of the sheets. The sheets conveyed to the horizontal aligning device 82 are guided to a space between the first aligning plate 47*b* and the second aligning plate 47*a*. The respective aligning plates nip the sheets to align the sheets in the conveying direction and the vertical direction. A damper is provided in the first aligning plate 47*b*. The damper may be a damper of a spring type or may be a damper formed of resin or the like having flexibility.

In this embodiment, a device including a rotor with paddle and a stopper is adopted as the vertical aligning device 81. A device including two aligning plates is adopted as the horizontal aligning device 82. However, sheet aligning devices including mechanisms different from these may be adopted for the vertical aligning device 81 and the horizontal aligning device 82.

Figure 5:
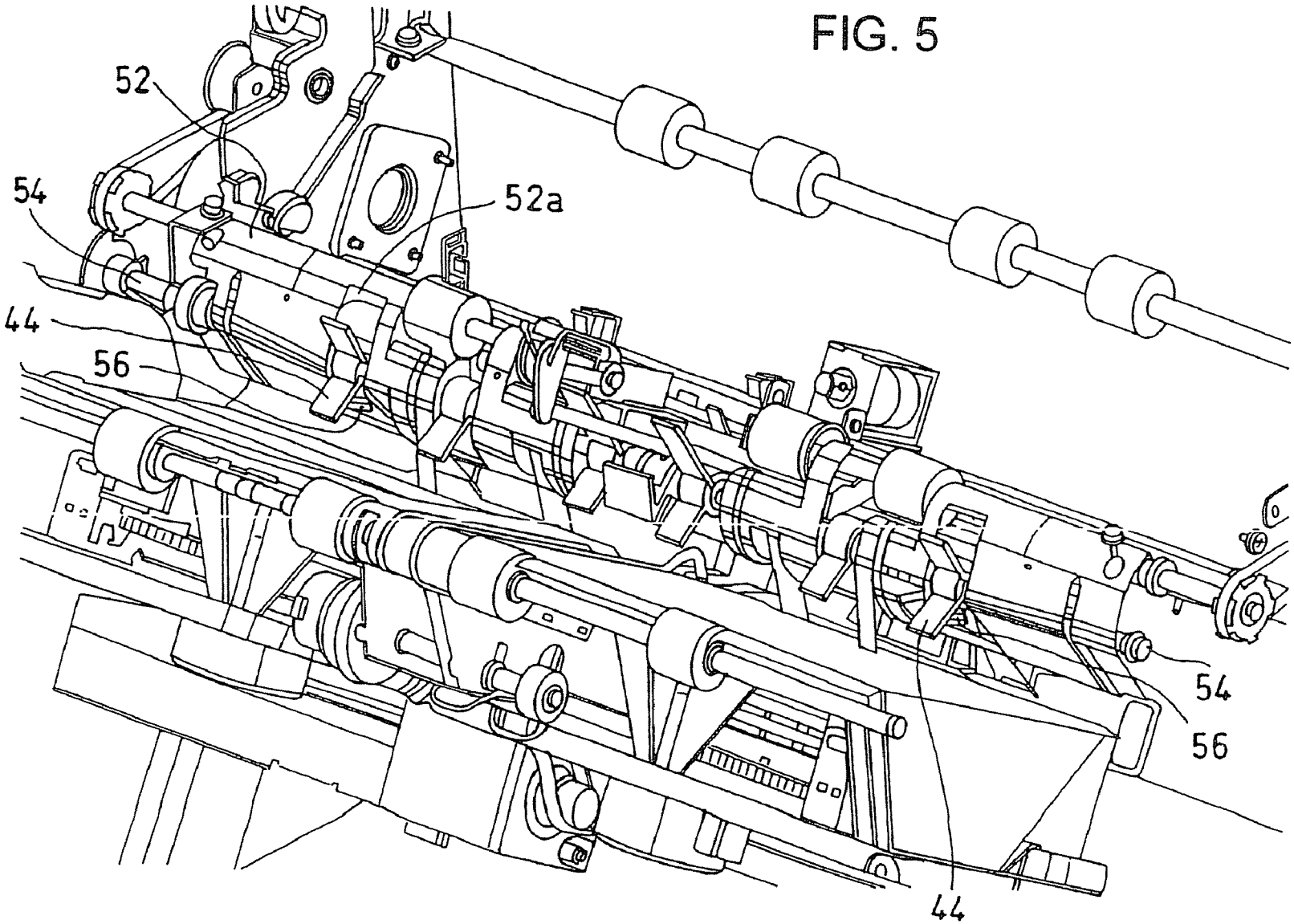
FIG. 5 is a perspective view in the case in which the vertical aligning device and the horizontal aligning device are built in a sheet post-processing apparatus.
Figure 6:
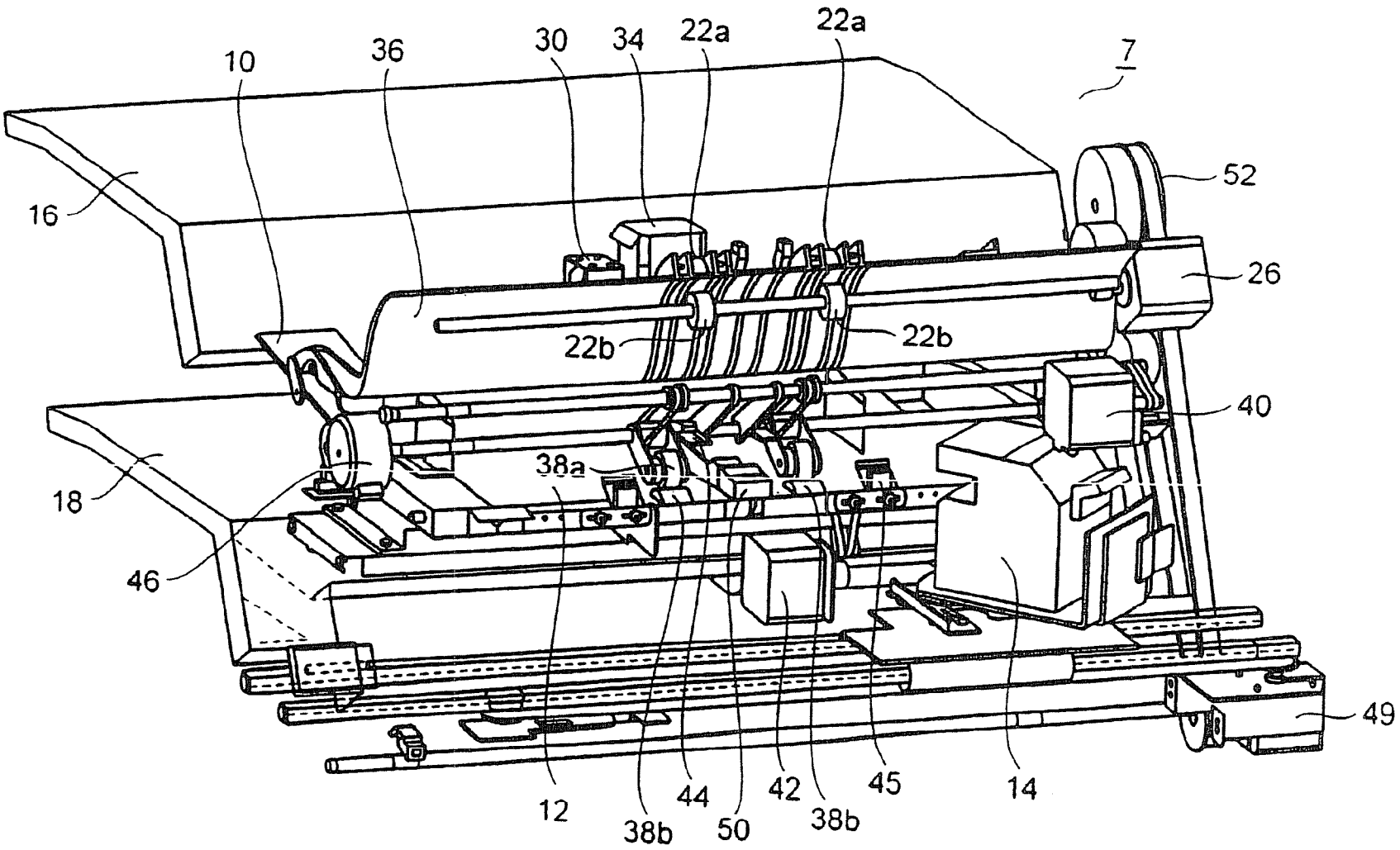
FIG. 6 is a perspective view in the case in which the vertical aligning device and the horizontal aligning device are built in the sheet post-processing apparatus.
Figure 7:
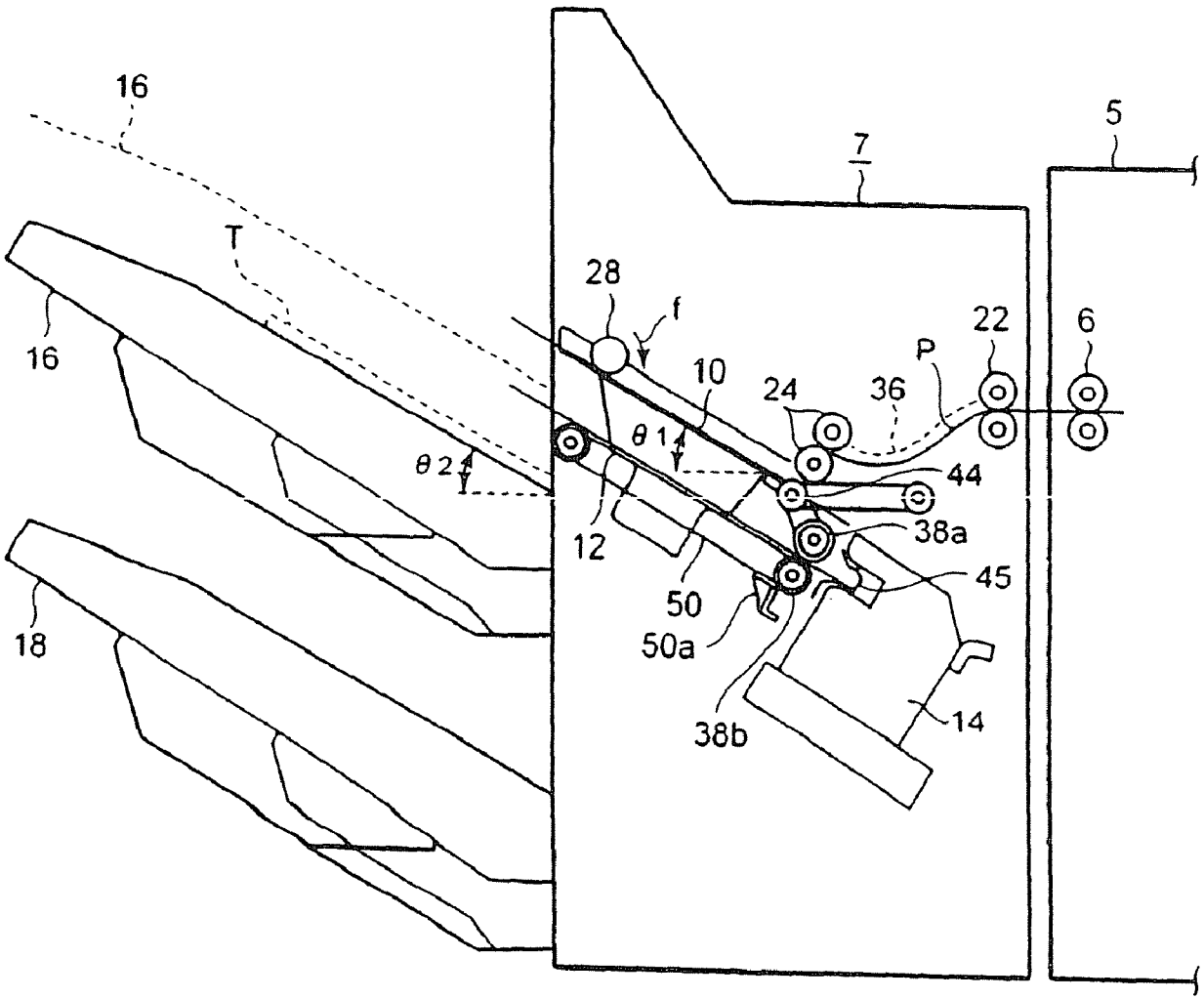
FIG. 7 is a schematic diagram showing the sheet post-processing apparatus in which the sheet aligning device is set.

FIGS. 5 and 6 are perspective views in the case in which the vertical aligning device 81 and the horizontal aligning device 82 according to this embodiment are built in the sheet post-processing apparatus. FIG. 7 is a schematic diagram showing a sheet post-processing apparatus 7, in which the sheet aligning device 80 according to this embodiment is set, arranged adjacent to an image forming apparatus 5 such as a copying machine. This sheet post-processing apparatus 7 basically includes a standby tray 10, a processing tray 12, a stapler 14, a first sheet discharge tray 16, and a second sheet discharge tray 18. In FIGS. 5 to 7, the vertical aligning device 81 and the horizontal aligning device 82 according to this embodiment are set in the processing tray 12.

Sheets P subjected to image formation in the image forming apparatus 5 such as a copying machine and discharged from a pair of sheet discharge rollers 6 are received by a pair of entrance rollers 22, supplied to a pair of sheet feeding rollers 24, and sent from the sheet feeding rollers 24 to the standby tray 10. The entrance rollers 22 are driven by an entrance roller motor 26. A paper path ceiling 36 that guides the sheets P to the sheet feeding rollers 24 is provided between the entrance rollers 22 and the standby tray 10. The entrance rollers 22 include an upper entrance roller 22*a* and a lower entrance roller 22*b*. The sheet feeding rollers 24 also include an upper sheet feeding roller and a lower sheet feeding roller.

The processing tray 12 that stacks the sheets P dropped and supplied from the standby tray 10 is arranged below the standby tray 10.

The processing tray 12 aligns and supports the sheets P stacked while the sheets P are subjected to staple processing by the stapler 14 serving as a processing mechanism for performing the post-processing. In a position where a trailing end of the sheets P fall when the sheets P are dropped and supplied to the processing tray 12, the vertical aligning device 81 having the rotatable paddle 44 for aligning the top sheet P placed on the processing tray 12 is arranged.

As shown in FIG. 7, the standby tray 10 is capable of dropping and supplying the sheets P to the processing tray 12 and, on the other hand, is capable of conveying the sheets P in a direction of the first or the second sheet discharge tray 16 or 18. The conveyance of the sheets P in the direction of the sheet discharge tray 16 or 18 is performed by bringing the standby tray roller 28, which performs alignment of the sheets P, into contact with the sheets P on the standby tray 10. Up and down movements of the standby tray roller 28 are controlled by a standby tray roller driving source 30.

The standby tray 10 is arranged at an inclination angle θ1 in order to support the sheets P in a state in which a leading end of the sheets P is higher than a trailing end thereof. The first or the second sheet discharge tray 16 or 18 is lifted and lowered by a sheet-discharge-tray driving unit 52 and selected. The first or the second sheet discharge tray 16 or 18 is lifted to height substantially the same as the height of the standby tray 10 or the processing tray 12 during stacking of the sheets P to realize improvement of alignability of the sheets P discharged. The first or the second sheet discharge tray 16 or 18 is arranged at an inclination angle θ2 in order to support the sheets P in a state in which the leading end of the sheets P is higher than the trailing end of thereof.

FIGS. 8A and 8B are timing charts of the horizontal aligning device 81 according to this embodiment. FIG. 8A is a timing chart of the horizontal alignment L motor 86, which moves the first aligning plate 47*b*, and the horizontal alignment L home position sensor 87. FIG. 83 is a timing chart of the horizontal alignment R motor 48, which moves the second aligning plate 47*a*, and the horizontal alignment R home position sensor 89.

When sheets conveyed to the horizontal aligning device 81 is equal to or smaller than a predetermined number, alignment is performed as follows. Before the sheets are conveyed, the respective aligning plates are located in a home position. The control unit 83 moves the first aligning plate 47*b* and the second aligning plate 47*a* located in a home position 61 to a standby position 62, which corresponds to the width of the sheets conveyed thereto, by rotating the horizontal alignment L motor 86 and the horizontal alignment R motor 48 in a regular rotation direction. The sheets conveyed thereto are guided to a space between the first aligning plate 47*b* and the second aligning plate 47*a*.

When the conveyance of the sheets is finished, the control unit 83 rotates the horizontal alignment L motor 86 and the horizontal alignment R motor 48 in the regular rotation direction to perform a driving operation for moving the first aligning plate 47*b* and the second aligning plate 47*a* to an alignment position 63 and aligns the sheets in a direction perpendicular to the conveying direction. The driving means aligning the sheets with an interval between the first aligning plate 47*b* and the second aligning plate 47*a* set narrower than a width in a horizontal alignment direction of the sheets to be aligned.

It is desirable that an amount of movement of the first aligning plate 47*b* and the second aligning plate 47*a* in the driving operation of this first alignment operation, i.e., a driving amount is, for example, equal to or larger than 0.4 mm and equal to or smaller than 2 mm. When the driving amount is smaller than this, alignment is insufficient and, when the driving amount is larger than this, since sheets bend, alignment is disarranged.

The driving operation may be performed every time one sheet is conveyed or may be performed only once when all the sheets are finished to be conveyed. If the driving operation is performed only once when all the sheets are finished to be conveyed, it is possible to minimize an increase in a processing time.

When stepping motors are used as the horizontal alignment L motor 86 and the horizontal alignment R motor 87, the control of the driving amount is performed by controlling the number of steps. When DC motors are used as the horizontal alignment L motor 86 and the horizontal alignment R motor 87, the control of the driving amount is performed by controlling driving times of the respective motors. In this embodiment, it is assumed that the stepping motors are used.

When the number of sheets conveyed thereto exceeds the predetermined number, alignment is performed as follows. The control unit 83 receives information on the number of sheets from the number-of-sheet counter 90 and determines whether this number of sheets has exceeded the predetermined number. When the number of sheets has exceeded the predetermined number, the control unit 83 increases the driving amount to be larger than a driving amount at the time when the number of sheets is equal to or smaller than the predetermined number.

For example, the control unit 83 increases the driving amount to be about twice as large as that in the case in which the number of sheets is equal to or smaller than the predetermined number, for example, increases the driving amount from 0.8 mm or more to 4 mm or less. If the driving amount is smaller than this, since a bundle of sheets stacked is thick, alignment is insufficient. When the driving amount is larger than this, since the sheets bend, alignment is disarranged. It is suitable that this driving amount is set according to the number of sheets to be aligned.

In the driving operation, when the thickness of a sheet bundle to be aligned is small, sturdiness of the sheet bundle is low. When the thickness of the sheet bundle is large, sturdiness of the sheet bundle is high. In this way, since the sturdiness changes according to the thickness of the bundle of sheets to be aligned, it is suitable that the driving amount is set according to the sturdiness of the bundle of sheets to be aligned.

The control unit 83 increases the number of times of the aligning operation of the horizontal aligning device 81. Specifically, the control unit 83 fixes the second aligning plate 47*a*, rotates the horizontal alignment L motor 86 in the regular rotation direction in a predetermined number of steps to press and align the sheets with the first aligning plate 47*b*, and subsequently rotates the horizontal alignment L motor 86 in a reverse rotation direction in the predetermined number of steps to separate the first aligning plate 47*b* from the sheets.

A combination of the pressing and the separating operations is performed, for example, twice. It is suitable that the number of times the combination is performed is increased or decreased according to the number of sheets to be aligned. This second aligning operation is performed after the first aligning operation. Before the second aligning operation is performed, the first aligning plate 47*b* may be returned to the standby position 62.

This second aligning operation may be performed every time a sheet is conveyed or may be performed when all the sheets are finished to be conveyed. Also, it may be performed every time the number of sheets exceeds the predetermined number. When the second aligning operation is performed when all the sheets are finished to be conveyed, it is possible to minimize an increase in a processing time.

Figures 9A, 9B:
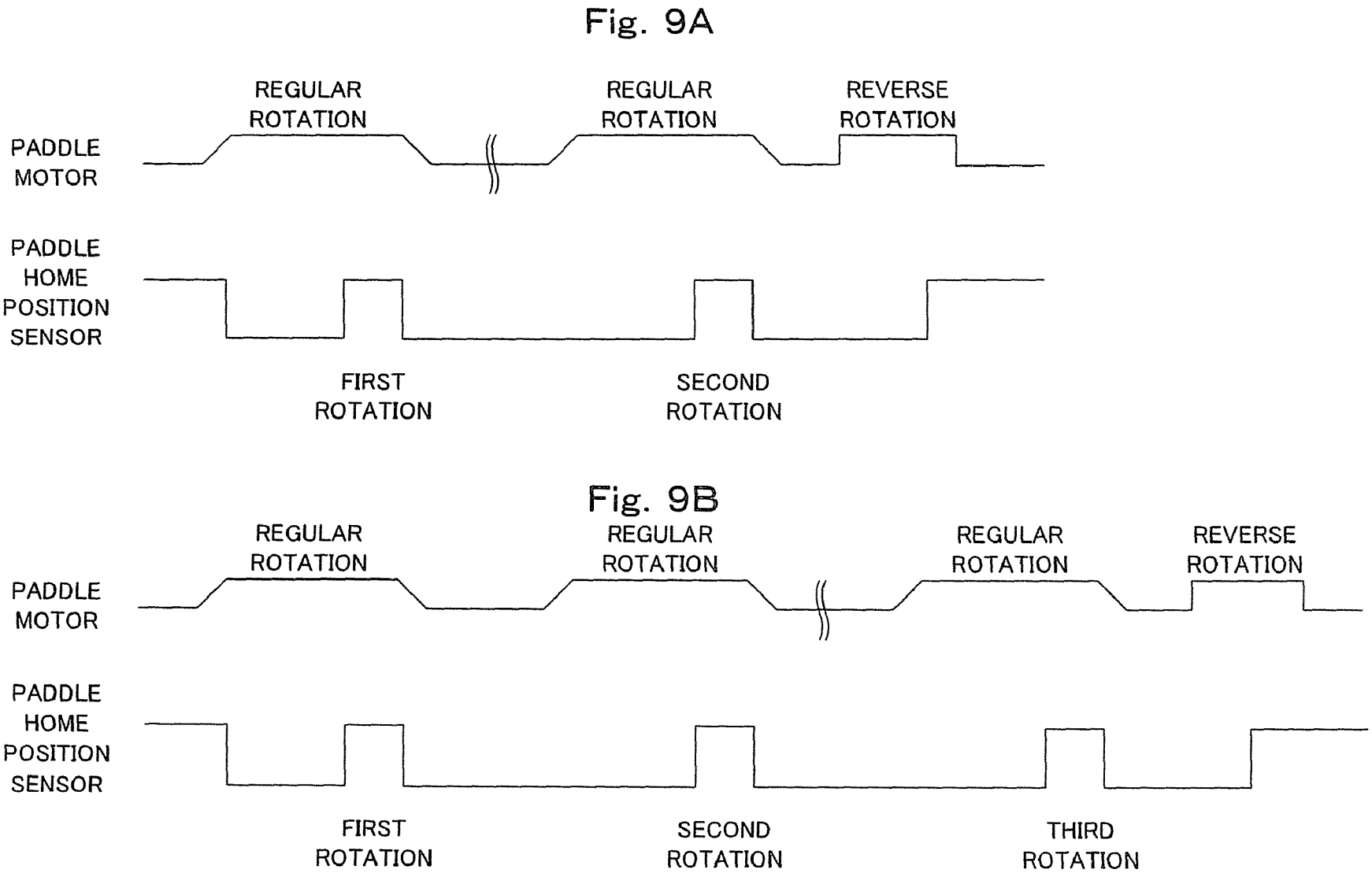
FIG. 9A is a timing chart of the vertical aligning device in the case in which the number of sheets conveyed thereto is equal to or smaller than a predetermined number.
FIG. 9B is a timing chart of the vertical aligning device in the case in which the number of sheets conveyed thereto exceeds the predetermined number.

Moreover, the control unit 83 increases the number of times of the aligning operation of the vertical aligning device 81. FIGS. 9A and 9B are timing charts of the vertical aligning device 81.

FIG. 9A is a timing chart of the vertical aligning device 81 in the case in which the number of sheets conveyed to the vertical aligning device 81 is equal to or smaller than the predetermined number. The paddle 44 of the vertical aligning device 81 is located in a home position until the sheets are conveyed thereto. When the sheets are conveyed thereto, the control unit 83 rotates the paddle motor 46 in a regular rotation direction to rotate the paddle 44 twice and, after that, reversely rotates the paddle motor 46 to return the paddle 44 to the home position.

FIG. 9B is a timing chart of the vertical aligning device 81 in the case in which the number of sheets conveyed to the vertical aligning device 81 exceeds the predetermined number. When the number of sheets conveyed thereto exceeds the predetermined number, the control unit 83 increases the number of times of alignment of the vertical aligning device 81. Specifically, the control unit 83 performs an aligning operation as follows. The paddle 44 of the vertical aligning device 81 is located in the home position before the sheets are conveyed thereto. When the sheets are conveyed thereto, the control unit 83 rotates the paddle motor 46 in the regular rotation direction to rotate the paddle 44 three times, which is one time more than that in the case in which the number of sheets conveyed thereto is equal to or smaller than the predetermined number, and, after that, reversely rotates the paddle motor 46 to return the paddle 44 to the home position.

In this way, in this embodiment, the paddle 44 is rotated three times when the number of sheets conveyed to the vertical aligning device 81 exceeds the predetermined number. However, the paddle 44 may be rotated four or more times. This aligning operation with the increased number of rotations may be performed every time a sheet is conveyed thereto or may be applied to only a last sheet conveyed thereto. When the aligning operation with the number of rotations increased is applied to only the last sheet conveyed thereto, it is possible to minimize an increase in a processing time.

The predetermined number of the number of sheets conveyed thereto forming a reference for increasing the number of times of the aligning operation or the driving amount may be set for each sheet size or each thickness of sheets. A default value of the predetermined number may be set and the user may be able to change the default value as appropriate. As an example of this predetermined number, it is possible to set the predetermined number to twenty. However, it is possible to set this number arbitrarily.

Moreover, it is also possible to increase the number of times of the aligning operation or the driving amount when the thickness of a sheet bundle exceeds a predetermined thickness. In this case, the thickness of a sheet bundle, the thickness of sheets, and the number of conveyed sheets forming references for increasing the number of times of the aligning operation or the driving amount are inputted to the control unit 83. It is possible to input the thickness of a sheet bundle and the thickness of sheets from, for example, an input device such as a touch panel provided in the sheet post-processing apparatus 7 or the image forming apparatus 5.

It is possible to input the thickness of a sheet bundle as a numerical value, for example, 10 mm. It is possible to input the thickness of sheets as a numerical value, for example, 30 $g/m^2$ or by selecting a type of sheets such as "thick", "standard", or "thin". The control unit 83 calculates the number of sheets forming a reference for increasing the number of times of the aligning operation or the driving amount according to calculation from these numerical values inputted or by reading a conversion table provided in advance for converting the thickness of a sheet bundle and the thickness of sheets into the number of sheets. When the number of sheets conveyed to the vertical aligning device 81 exceeds the number of sheets forming the reference, the control unit 83 determines that the sheet bundle has exceeded the predetermined thickness and increase the number of times of the aligning operation or the driving amount.

Operations of the sheet post-processing apparatus according to this embodiment integrated with the sheet aligning device 80 will be explained using FIG. 7. When the sheets P are subjected to image formation in the image forming apparatus 5 and supplied from sheet discharging rollers 6, the sheet post-processing apparatus 7 performs different kinds of operation depending on whether the post-processing for the sheets P is performed or not performed or whether the post-processing for the preceding sheets P is being executed or the post-processing has been finished.

When the post-processing is not performed, for example, the first sheet discharge tray 16 has slid to a position indicated by a dotted line in FIG. 7 and is capable of stacking, with high alignability, the sheets P discharged from the standby tray 10. When the post-processing is not performed, the sheets P conveyed from the entrance rollers 22 to the sheet feeding rollers 24 via the paper path ceiling 36 are fed to the standby tray 10 by the sheet feeding roller 24. Subsequently, the sheets P are lowered onto the standby tray 10, conveyed by the standby tray roller 28 rotated in an arrow f direction, and discharged to the first sheet discharge tray 16.

In this way, sheets are sequentially stacked on the first sheet discharge tray 16. The first sheet discharge tray 16 is arranged to have an inclination angle θ2 and a leading end of the sheets is higher than a trailing end of the sheets. Thus, for example, even if the sheets P are discharged onto the first sheet discharge tray 16 in a state in which the sheets P are curled as indicated by a dotted line in FIG. 9, the sheets P placed on the first sheet discharge tray 16 earlier are not pushed out by contact with the leading end of the following sheet P. In other words, the discharged sheets P are sequentially placed on the sheet discharge tray 16 in order without being disordered. Even if the preceding sheets P are pushed by the following sheet P and some positional shift is caused, since the first sheet discharge tray 16 has the inclination angle θ2, the sheets P fall because of their own weight and are aligned and stacked in a state in which the trailing end thereof is even on the first sheet discharge tray 16.

When sheets subjected to image formation in the image forming apparatus 5 are received and the post-processing such as stapling and sorting is not performed, the sheet discharge tray 16 or 18 does not perform any up and down operation at all until sheets discharged from the sheet post-processing apparatus 7 reach a predetermined number. It is possible to count the number of discharged sheets with, for example, a sheet upper surface detecting sensor (not shown) that detects an upper surface of sheets.

When sheets stacked on the sheet discharge tray 16 or 18 reach the predetermined number, the sheet discharge tray 16 or 18 perform the up and down operation and a sheet trailing end is prevented from remaining in the sheet discharge port (not shown) of the sheet post-processing apparatus 7 to perform accurate upper surface detection.

It is suitable that, after the sheets reach the predetermined number, a standstill state of the sheet discharge tray 16 or 18 is maintained until the sheet upper surface detecting sensor is in the ON state for a predetermined time or more, for example, 5 msec or more. This is because, in general, presence of a dead zone is inevitable in actuators of various sensors and the like.

Here, the upper surface of the sheets is detected in order to manage the number of sheets on the sheet discharge tray 16 or 18 not to exceed a stackable number of sheets thereof and grasp a present movable position of the sheet discharge tray 16 or 18.

The set number of sheets described above may be set as, for example, forty as a default at the time of shipment of the sheet post-processing apparatus 7 or a user may be able to set the number of sheets.

A stroke amount of the up and down operation of the sheet discharge tray 16 or 18 is set to at least about 50 mm. This is because, when the stroke amount is too small, hooking at the sheet trailing end cannot be released. On the other hand, when the stroke amount is too large, the up and down operation of the sheet discharge tray 16 or 18 takes time and productivity is deteriorated.

The stroke amount of the up and down operation of the sheet discharge tray 16 or 18 may be set as a default at the time of shipment of the sheet post-processing apparatus 7 or the user may be able to set the stroke amount.

It is suitable that the up and down operation of the sheet discharge tray 16 or 18 is faster at the time of lowering than at the time of lifting. This is because sheets fall to the sheet discharge tray 16 or 18 faster.

A case in which the staple processing as the post-processing is performed and there is no sheets P, for which the staple processing is being executed earlier, on the processing tray 20 will be described.

In this case, the standby tray 10 drops and supplies the sheet P onto the processing tray 12. As shown in FIG. 7, in order to align the horizontal direction of the sheet P, the horizontal aligning plates 47*a* and 47*b* are arranged such that an interval between the horizontal aligning plates 47*a* and 47*b* are substantially the same as the width of the sheet P. Consequently, the sheet P fed by the sheet feeding rollers 24 is dropped and supplied onto the processing tray 12 through the standby tray 10.

During the drop and supply, the upper vertical aligning roller 38*a* is retracted upward and the receiving unit 44*a* of the paddle 44 receives the trailing end of the sheet P. Both the sides of the sheet P fall while being in contact with the first aligning plate 47*b* and the second aligning plate 47*a* of the horizontal aligning device 82, the sheet P is aligned in the horizontal direction, and the aligning operation in the horizontal direction is performed.

The paddle 44 of the vertical aligning device 81 rotates in an arrow o direction, drops the trailing end of the sheet P from the receiving unit 44*a*, and taps down the sheet P onto the processing tray 12 with the tapping unit 44*b*. Moreover, the paddle 44 sends the sheet P in an arrow q direction with the sending unit 44*c*, brings the trailing end of the sheet P into contact with the stopper 45, and completes the alignment in the vertical direction of the sheet P. Details of the aligning operation in the vertical direction are as described above.

In this way, the sheets P subjected to image formation are stacked on the processing tray 12 from the sheet feeding rollers 24 through the standby tray 10 while being sequentially aligned in the horizontal direction and the vertical direction. When the sheets P reach the predetermined number, the stapler 14 staples the sheets P on the processing tray 12 in a desired position in a bundle to form the sheet bundle T. Thereafter, the upper vertical aligning roller 38*a* is lowered onto the sheet bundle. The sheet bundle T is held by the upper vertical aligning roller 38*a* rotating in an arrow r direction and the lower vertical aligning roller 38*b* rotating in an arrow s direction to be conveyed in a direction of the first sheet discharge tray 16.

When the trailing end of the sheet bundle T passes the upper and the lower vertical aligning rollers 38*a* and 38*b*, the trailing end is hooked by the sending pawl 50*a* of the conveyor belt 50 rotated in an arrow t direction and discharged onto the first sheet discharge tray 16.

At this point, the first sheet discharge tray 16 is slid from the position indicated by the dotted line to a position indicated by a solid line in FIG. 7. Since the first sheet discharge tray 16 is arranged to have the inclination angle θ2 and the sheet leading end is higher than the trailing end, the sheets P discharged onto the first sheet discharge tray 16 earlier are not pushed out because of contact with the leading end of the following sheet bundle T. Even if the preceding sheet bundle T is pushed by the following sheet P and some positional shift is caused, since the first sheet discharge tray 16 has the inclination angle θ2, the sheet bundle T falls because of its own weight and is aligned and stacked in a state in which the trailing end thereof is even on the first sheet discharge tray 16. The staple processing for the sheets P is completed.

A case in which the staple processing as the post-processing is performed and the sheets P, for which the staple processing is being executed earlier, remain in the processing tray 20 will be described.

In this case, the standby tray 10 is capable of supporting the sheets P. The standby tray roller 28 is retracted to above the standby tray 10 not to hinder the sheets P. The sheets P discharged from the image forming apparatus 5 and supplied by the sheet feeding rollers 24 are temporarily placed on the standby tray 10 in order to wait for the processing tray 12 to be empty.

The sheets P placed on the standby tray 10 is vertically aligned by the standby tray roller 28 rotated in a direction opposite to the arrow f direction. Moreover, since the standby tray 10 is arranged to have the inclination angle θ1 and the sheet leading end is higher than the trailing end, the sheets P are vertically aligned by their own weights as well.

Since the standby tray 10 is arranged to have the inclination angle θ1, for example, even if the sheets P are supplied from the sheet feeding rollers 24 and fed onto the standby tray 10 in a state in which the sheets P are curled, the sheets P placed on the standby tray 10 earlier are not pushed out by contact with the leading end of the following sheet P. In other words, the supplied sheets P are placed on the standby tray 10 in order without being disordered. Even if the preceding sheets P are pushed by the following sheet P and some positional shift is caused, since the standby tray 10 has the inclination angle θ1, the sheets P fall because of their own weight and are aligned and stacked in a state in which the trailing end thereof is even on the standby tray 10.

When the preceding sheets P on the processing tray 12 are discharged to the first sheet discharge tray 16 side and the processing tray 12 is emptied, the standby tray 10 drops and supplies the sheets P onto the processing tray 12. At this point, the first aligning plate 47*b* and the second aligning plate 47*a* of the horizontal aligning device 82 are arranged such that an interval between the aligning plates is substantially the same as the width of the sheets P. Therefore, both the sides of the sheets P dropped from the standby tray 10 are regulated by the respective horizontal aligning plates 47*a* and 47*b*, the horizontal direction of the sheets P is aligned, and the aligning operation in the horizontal direction is performed.

The sheet P on the lower side of the two sheets P dropped to the processing tray 12 is sent in the arrow q direction by the lower vertical aligning roller 38*b* rotated in the direction opposite to the arrows direction, the trailing end of the sheet P is brought into contact with the stopper 45, and the alignment in the vertical direction of the sheet P is completed. The sheet P on the upper side of the two sheets P dropped to the processing tray 12 is sent in the arrow q direction by the upper vertical aligning roller 38*a* rotated in the direction opposite to the arrow r direction, the trailing end of the sheet P is brought into contact with the stopper 45, and the alignment in the vertical direction of the sheet P is completed. Thereafter, the upper vertical aligning roller 38*a* is retracted upward. Details of the aligning operation in the vertical direction are as described above.

The third and subsequent sheets P discharged from the image forming apparatus 5 are directly dropped and supplied to the processing tray 12 without being put on standby on the standby tray 10. Thereafter, the third and subsequent sheets P are sequentially aligned on the sheets P, which are stacked on the processing tray 12 earlier, by the paddle 44 of the vertical aligning device 81.

When the sheets P stacked on the processing tray 12 reach the predetermined number, the sheets P are subjected to the staple processing by the stapler 14 to form the sheet bundle T. Thereafter, the sheet bundle T is conveyed in the direction of the first sheet discharge tray 16 by the upper and the lower vertical aligning rollers 38*a* and 38*b*, the trailing end of the sheet bundle T is hooked by the sending pawl 50*a* of the conveyor belt 50, the sheet bundle T is discharged onto the first sheet discharge tray 16, and the staple processing for the sheets P is completed.

The image forming apparatus including the sheet post-processing apparatus integrated with the sheet aligning device 80 according to this embodiment will be explained. As shown in FIG. 7, this sheet post-processing apparatus 7 is installed adjacent to the image forming apparatus 5. Sheets subjected to image formation by the image forming apparatus 5 are discharged from the sheet discharging rollers 6 and supplied to the sheet post-processing apparatus 7 from the entrance rollers 22 of the sheet post-processing apparatus 7.

As described above, in the sheet post-processing apparatus 7 according to this embodiment, in the case of staple processing, when the number of sheets conveyed to the sheet aligning device 80 exceeds the predetermined number, the sheet aligning device 80 increases the number of times of the aligning operation of the vertical aligning device 81 and the number of times of the aligning operation of the horizontal aligning device 82 to be larger than the number of times of the aligning operation at the number of sheets equal to or smaller than the predetermined number. The sheet aligning device 80 increases the driving amount of the horizontal aligning device 82 to be larger than the driving amount at the number of sheets equal to or smaller than the predetermined number. Therefore, even when the number of sheets conveyed to the sheet aligning device 80 is small or large, the sheet aligning device 80 can perform appropriate alignment processing and the sheet post-processing apparatus 7 can appropriately perform staple processing.

It is possible to minimize an increase in a processing time by performing the aligning operation with the number of times or the driving amount increased when all the sheets are conveyed.

Since it is possible to appropriately set the number of times of the aligning operation of the vertical aligning device 81 and the number of times of aligning operation and the driving amount of the horizontal aligning device 82 according to the number of sheets to be aligned, a size of the sheets, or the thickness of the sheets, it is possible to perform an aligning operation suitable for sturdiness of a sheet bundle to be aligned and perform appropriate alignment processing.

When the control unit 83 receives, from an external counter, information on the number of sheets conveyed to the sheet aligning device 80, since it is unnecessary to provide an apparatus such as a sensor that counts the number of sheets, it is possible to hold down manufacturing cost.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A sheet post-processing apparatus comprising:

a processing tray that receives sheets subjected to image formation from an image forming apparatus;

a sheet discharge tray that stacks the sheets discharged after processing in a post process; and a sheet aligning device having:

a first sheet aligning device that includes a stopper, which stops the sheets, and a rotor having a paddle provided radially with respect to a rotation axis, rotates the paddle to draw in the sheets, and strikes the sheets against the stopper, thereby aligning the sheets in a conveying direction, a second sheet aligning device that aligns the sheets in a direction perpendicular to the conveying direction, and a control unit that controls aligning operations of the first sheet aligning device and the second sheet aligning device and increases, in subjecting the sheets to staple processing, when a number of the sheets conveyed thereto exceeds a predetermined number, a number of times of the aligning operation of the first sheet aligning device to be larger than a number of times of the aligning operation at a number of sheets equal to or smaller than the predetermined number of sheets.

2. A sheet post-processing apparatus according to claim 1, wherein, when the number of sheets conveyed to the processing tray exceeds the predetermined number, the control unit increases, in aligning the sheet conveyed thereto last, the number of times of the aligning operation of the first sheet aligning device to be larger than the number of times of the aligning operation at the number of sheets equal to or smaller than the predetermined number.

3. A sheet post-processing apparatus according to claim 1, wherein, the second sheet aligning device includes a first aligning plate and a second aligning plate which nip the sheets conveyed to the processing tray in a direction perpendicular to the conveying direction, and moves the first aligning plate and the second aligning plate in a direction of the sheets and presses the sheets, thereby aligning the sheets in the direction perpendicular to the conveying direction.

4. A sheet post-processing apparatus according to claim 3, wherein, the control unit controls aligning operations of the first sheet aligning device and the second sheet aligning device and increases, in subjecting the sheets to staple processing, when a number of the sheets conveyed thereto exceeds a predetermined number, a number of times of the aligning operation of the second sheet aligning device to be larger than a number of times of the aligning operation at a number of sheets equal to or smaller than the predetermined number of sheets.

5. A sheet post-processing apparatus according to claim 3, wherein, the control unit controls aligning operations of the first sheet aligning device and the second sheet aligning device and increases, when a number of the sheets conveyed thereto exceeds a predetermined number, an amount of movement of the first aligning plate or the second aligning plate in the sheet direction to be larger than an amount of movement at a number of sheets equal to or smaller than the predetermined number of sheets.

6. A sheet post-processing apparatus according to claim 3, wherein, the control unit controls aligning operations of the first sheet aligning device and the second sheet aligning device and increases, in subjecting the sheets to staple processing, when the thickness of a sheet bundle exceeds a predetermined thickness, a number of times of the aligning operation of the second sheet aligning device to be larger than a number of times of the aligning operation at a thickness of the sheet bundle equal to or smaller than the predetermined thickness of the sheet bundle.

7. A sheet post-processing apparatus according to claim 3, wherein, the control unit controls aligning operations of the first sheet aligning device and the second sheet aligning device and increases, when the thickness of a sheet bundle exceeds a predetermined thickness, an amount of movement of the first aligning plate or the second aligning plate in the sheet direction to be larger than an amount of movement at a thickness of the sheet bundle equal to or smaller than the predetermined thickness of the sheet bundle.

8. A sheet post-processing apparatus according to claim 1, wherein, when the thickness of a sheet bundle exceeds a predetermined thickness, the control unit increases, in aligning the sheet conveyed thereto last, the number of times of the aligning operation of the first sheet aligning device to be larger than the number of times of the aligning operation at the number of sheets equal to or smaller than the predetermined thickness of the sheet bundle.

9. A sheet post-processing apparatus comprising:

a processing tray that receives sheets subjected to image formation from an image forming apparatus;

a sheet discharge tray that stacks the sheets discharged after processing in a post process; and a sheet aligning device having:

a first sheet aligning device that includes a stopper, which stops the sheets, and a rotor having a paddle provided radially with respect to a rotation axis, rotates the paddle to draw in the sheets, and strikes the sheets against the stopper, thereby aligning the sheets in a conveying direction, a second sheet aligning device that aligns the sheets in a direction perpendicular to the conveying direction, and a control unit that controls aligning operations of the first sheet aligning device and the second sheet aligning device and increases, in subjecting the sheets to staple processing, when the thickness of a sheet exceeds a predetermined thickness, a number of times of the aligning operation of the first sheet aligning device to be larger than a number of times of the aligning operation at a thickness of the sheet equal to or smaller than the predetermined thickness of the sheet.

10. A sheet post-processing apparatus according to claim 9, wherein, when the thickness of a sheet exceeds a predetermined thickness, the control unit increases, in aligning the sheet conveyed thereto last, the number of times of the aligning operation of the first sheet aligning device to be larger than the number of times of the aligning operation at the thickness of the sheet equal to or smaller than the predetermined thickness of the sheet.

11. A sheet post-processing apparatus according to claim 9, wherein, the second sheet aligning device includes a first aligning plate and a second aligning plate which nip the sheets conveyed to the processing tray in a direction perpendicular to the conveying direction, and moves the first aligning plate and the second aligning plate in a direction of the sheets and presses the sheets, thereby aligning the sheets in the direction perpendicular to the conveying direction.

12. A sheet post-processing apparatus according to claim 11, wherein, the control unit controls aligning operations of the first sheet aligning device and the second sheet aligning device and increases, in subjecting the sheets to staple processing, when the thickness of a sheet exceeds a predetermined thickness, a number of times of the aligning operation of the second sheet aligning device to be larger than a number of times of the aligning operation at a thickness of the sheet equal to or smaller than the predetermined thickness of the sheet.

13. A sheet post-processing apparatus according to claim 11, wherein, the control unit controls aligning operations of the first sheet aligning device and the second sheet aligning device and increases, when the thickness of a sheet exceeds a predetermined thickness, an amount of movement of the first aligning plate or the second aligning plate in the sheet direction to be larger than an amount of movement at a thickness of the sheet equal to or smaller than the predetermined thickness of the sheet.

14. A sheet post-processing apparatus according to claim 11, wherein, the control unit controls aligning operations of the first sheet aligning device and the second sheet aligning device and increases, in subjecting the sheets to staple processing, when the thickness of a sheet bundle exceeds a predetermined thickness, a number of times of the aligning operation of the second sheet aligning device to be larger than a number of times of the aligning operation at a thickness of the sheet bundle equal to or smaller than the predetermined thickness of the sheet bundle.

15. A sheet post-processing apparatus according to claim 11, wherein, the control unit controls aligning operations of the first sheet aligning device and the second sheet aligning device and increases, when the thickness of a sheet bundle exceeds a predetermined thickness, an amount of movement of the first aligning plate or the second aligning plate in the sheet direction to be larger than an amount of movement at a thickness of the sheet bundle equal to or smaller than the predetermined thickness of the sheet bundle.

16. A sheet post-processing apparatus according to claim 9, wherein, when the thickness of a sheet bundle exceeds a predetermined thickness, the control unit increases, in aligning the sheet conveyed thereto last, the number of times of the aligning operation of the first sheet aligning device to be larger than the number of times of the aligning operation at the thickness of the sheet equal to or smaller than the predetermined thickness of the sheet bundle.

17. A sheet post-processing method comprising:

a control unit controls aligning operations of a first sheet aligning device includes a rotor having a paddle provided radially with respect to a rotation axis and a second sheet aligning device and increases, in subjecting the sheets to staple processing, when a number of the sheets conveyed thereto exceeds a predetermined number, a number of times of the aligning operation of the first sheet aligning device to be larger than a number of times of the aligning operation at a number of sheets equal to or smaller than the predetermined number of sheets.

18. A sheet post-processing method according to claim 17, wherein, when the number of sheets conveyed to the processing tray exceeds the predetermined number, the control unit increases, in aligning the sheet conveyed thereto last, the number of times of the aligning operation of the first sheet aligning device to be larger than the number of times of the aligning operation at the number of sheets equal to or smaller than the predetermined number.

19. A sheet post-processing method according to claim 17, wherein, when the thickness of a sheet exceeds a predetermined thickness, the control unit increases, in aligning the sheet conveyed thereto last, the number of times of the aligning operation of the first sheet aligning device to be larger than the number of times of the aligning operation at the thickness of the sheet equal to or smaller than the predetermined thickness of the sheet.

* * * * *